United States Patent [19]

Booth

[11] Patent Number: 4,821,949

[45] Date of Patent: Apr. 18, 1989

[54] LOCKING CARTON BOTTOM

[75] Inventor: Vernard Booth, Americas, Ga.

[73] Assignee: Georgia-Pacific Corporation, Atlanta, Ga.

[21] Appl. No.: 159,746

[22] Filed: Feb. 24, 1988

[51] Int. Cl.[4] ..... B65D 5/10

[52] U.S. Cl. ..... 229/157; 229/156

[58] Field of Search ..... 229/155–157, 229/185

[56] References Cited

U.S. PATENT DOCUMENTS

| | | | |
|---|---|---|---|
| 526,782 | 10/1894 | Howe et al. | 229/157 |
| 1,997,667 | 4/1935 | Woerner, Jr. | 229/39 |
| 2,053,857 | 9/1936 | Weiss | 229/157 |
| 2,339,224 | 1/1944 | Shina | 229/39 |
| 2,361,603 | 10/1944 | Cohen et al. | 229/157 |
| 2,990,993 | 7/1961 | Buttery | 229/39 |
| 3,539,090 | 11/1970 | Blasdell | 229/185 |
| 4,279,377 | 7/1981 | Peeples et al. | 229/157 |
| 4,367,840 | 1/1983 | McFadden | 229/157 |
| 4,650,112 | 3/1987 | Booth | 229/157 |
| 4,702,408 | 10/1987 | Powlenko | 229/185 |

FOREIGN PATENT DOCUMENTS

| | | | |
|---|---|---|---|
| 218420 | 4/1961 | Austria | 229/39 |
| 1016913 | 9/1977 | Canada | 229/155 |

OTHER PUBLICATIONS

"Exhibits B & C" by Crown Zellerbach Corp., 9-12-83, 8-8-84.

*Primary Examiner*—Stephen Marcus
*Assistant Examiner*—Gary E. Elkins
*Attorney, Agent, or Firm*—Banner, Birch, McKie & Beckett

[57] ABSTRACT

A paperboard carton having a self-locking bottom for holding heavy produce and the like which may be made with minimum waste and cutout material. The minor or width flaps have an inwardly folding flap locking segment which, when folded, defines a generally rectangular opening centrally located along the outer edge of the minor flaps. The major or width flaps have a flap locking slit formed therein. An assembly flap hingedly formed in the major flap may be folded inwardly to create an assembly slot along a portion of the flap locking slit. Locking edges of the rectangular opening in the minor flaps engage a locking edge of the slits in the major flap to securely form the carton bottom.

12 Claims, 3 Drawing Sheets

LOCKING CARTON BOTTOM

BACKGROUND OF THE INVENTION

This invention relates to cartons or containers suitable for produce and the like. These cartons are commonly constructed of a corrugated paperboard. More particularly, the invention is concerned with an interlocking bottom closure for a carton. Specifically, the invention relates to an improved self-locking carton bottom which can be efficiently and economically manufactured with minimal waste of material and with minimal cutouts which can jam manufacturing machinery and interfere with removing or "stripping" the box from the machinery.

Corrugated paperboard cartons having a wide variety of construction are well-known in the art. Many of these carton designs employ a plurality of overlapping closure flaps which interlock in various fashions to securely close the top of the carton and a plurality of overlapping bottom closure flaps interlocked to securely close the bottom of the carton. In constructing cartons or containers for fresh fruits and vegetables, it is especially important to provide a strong bottom closure arrangement capable of supporting the considerable weight of the contents.

Frequently the carton manufacturer is located far from where the commodities are to be packed. Thus, as a practical matter, the carton must be capable of being shipped in a flat, collapsed configuration to use shipping and storage space efficiently. Once at the packing location, the flat, collapsed carton must be constructed to be easily fully assembled without requiring skilled personnel or complex equipment. Thus, the action necessary to convert the flat carton from its collapsed condition to its fully assembled state should be performable quickly and simply, preferably without the need to utilize glue, staples or other equipment to secure the carton closure flaps.

For many years, the corrugated paperboard industry has needed a produce box that has a self-locking bottom capable of holding heavy loads such as potatoes, squash, cucumbers, etc. While numerous designs have been tried, these have generally failed in attempting to accommodate heavier loads.

Some bottom closure assemblies have adopted the use of a solid blank bottom, but this requires a large amount of corrugated paperboard in the manufacture and thus is too costly. Another previous approach to enable handling heavy product loads and still have an economical carton was to require the bottom to be glued or stapled, commonly referred to as "stitched." This type carton is not favored as a practical matter because the user does not want to take stitching equipment into the field. Also the user does not want to glue or staple the carton bottoms in advance because these "made-up" cartons require too much room for storage and/or transport to the field location where the produce is being harvested.

U.S. Pat. No. 4,650,112, commonly invented and assigned, discloses a carton for heavy produce and the like having a selflocking bottom which does not require glue or staples. This carton, however, requires a rectangular cutout segment in the minor or width flaps and an L-shaped cutout in the major or length flaps. These cutouts create significant waste problems. They must be collected, packaged, and disposed of at considerable trouble and expense. Of even greater concern, however, is that the cutouts have a tendency to jam or otherwise interfere with the high speed machinery used to manufacture the cartons. The cutouts also have a tendency to inhibit efficient removal or "stripping" of the carton blank from the machinery.

SUMMARY OF THE INVENTION

A principal object of the present invention is to provide an interlocking bottom closure for a corrugated paperboard carton which may be quickly and easily assembled from a flat carton blank and which has sufficient strength to carry heavy objects.

A further primary object of the present invention is to provide a carton in accordance with the above object which possesses a strong bottom closure without have the need for tape, glue, staples or other fasteners to close the carton bottom.

A further object of the present invention is to provide a carton with an interlocking bottom closure with is collapsible so that the cartons may be shipped in a flat, collapsed configuration.

A further object of the invention is to provide a carton formed from a blank which may be economically and efficiently manufactured and which has a minimum amount of cutout, waste material.

The above and other objects of the invention are accomplished by employing a unitary carton blank having a series of wall panels forming a pair of sidewalls and a pair of end walls. In conventional fashion, the panels are hingedly coupled in series along parallel fold lines with an appropriate fastening flap at the end of the series of panels to connect the panels into a tubular carton body. Each of the panels forming a sidewall has a major closure flap hingedly connected along an edge of this panel and each of the panels forming an end wall has a minor closure flap hingedly connected along an edge thereof.

A generally rectangular flap locking segment is formed centrally along the outer end portion of each of the minor flaps. The flap locking segment is hingedly connected to the minor flaps so that the flap locking segment may be folded inwardly. The inwardly folded flap locking segment defines a generally rectangular opening disposed centrally along the outer end of the minor flap. This opening defines spaced locking edges at the opposite ends of the opening and projecting tabs on the end portion of the minor flap disposed laterally of the ends of the opening.

A flap locking slit is formed adjacent each end of each of the major flaps. The flap locking slits have a first portion and a second portion. The first portion extends across the major flap and terminates adjacent the hinge line connecting the major flap to a sidewall of the carton body. This first portion may be angularly disposed with respect to the hinge line. The second portion of the flap locking slits extends longitudinally along the major flap. Thus, this second portion provides an edge extending generally parallel to the hinge line connecting the major flap to a sidewall. The intersection of the first and second portions of the flap locking slit defines a flap retaining segment for retaining the minor closure flaps in their assembled position when inserted into the flap locking slit, as further explained below.

The second portion of the flap locking slit preferably has means for providing flexibility to the flap retaining segment. Preferably this comprises an angular slit angularly disposed with respect to the second portion of the flap locking slit and angularly disposed to the direction of corrugation.

A single transverse fold line extends the full length of each of the minor flaps to divide the minor flaps into outer and inner sections with each inner section being hingedly connected to one of the end walls and the rectangular opening and tabs carried by the outer section.

Preferably an assembly flap is formed in the major flap adjacent the first portion of the flap locking slit. The assembly flap is hingedly connected to the major flap along an assembly flap hinge line. The assembly flap thus may be folded inwardly thereby transforming the first portion of the flap locking slit into an assembly slot to facilitate inserting the minor flaps through the major flaps. Preferably the assembly flap hinge line is substantially perpendicular to the hinge line between the sidewall and the major flap so that, as a result of the angularly disposed first portion, the assembly slot increases in width towards the outer end portion of the major flap.

In order to assemble the carton of the present invention, the major flaps are folded inwardly to lie in a common plane. The flap locking segment on each of the minor flaps is folded inwardly to thereby create the rectangular opening and projecting tabs on the end portion of the minor flaps. The assembly flap is also folded inwardly to thereby create the assembly slot. The tabs of the end portion of the minor flaps are then inserted through the slit and slot configuration of the major flaps until the locking edges of the rectangular opening lockingly engage with the locking edges in the major flaps.

Since the rectangular flap locking segment is hingedly connected to the minor flaps and merely folded inwardly to define the rectangular opening on the ends of the minor flaps, no waste material is produced from forming this structure. Similarly, since the assembly flap is folded inwardly to form the assembly slot, no waste material is formed from this structure. Thus, the paperboard blank of the present invention may be manufactured without any appreciable waste paperboard material. The elimination of waste material greatly simplifies the process of manufacturing the paperboard blank and eliminates the need to collect and dispose of waste material.

The above and other objects of this invention will become more apparent by reference to the detailed description given hereinbelow. The novel features of this invention are particularly recited in the appended claims, but the invention will be understood more fully and clearly from the following detailed description of the invention given with reference to the accompanying drawings.

DETAILED DESCRIPTION OF THE PREFERRED EMBODIMENT

Figure 1:
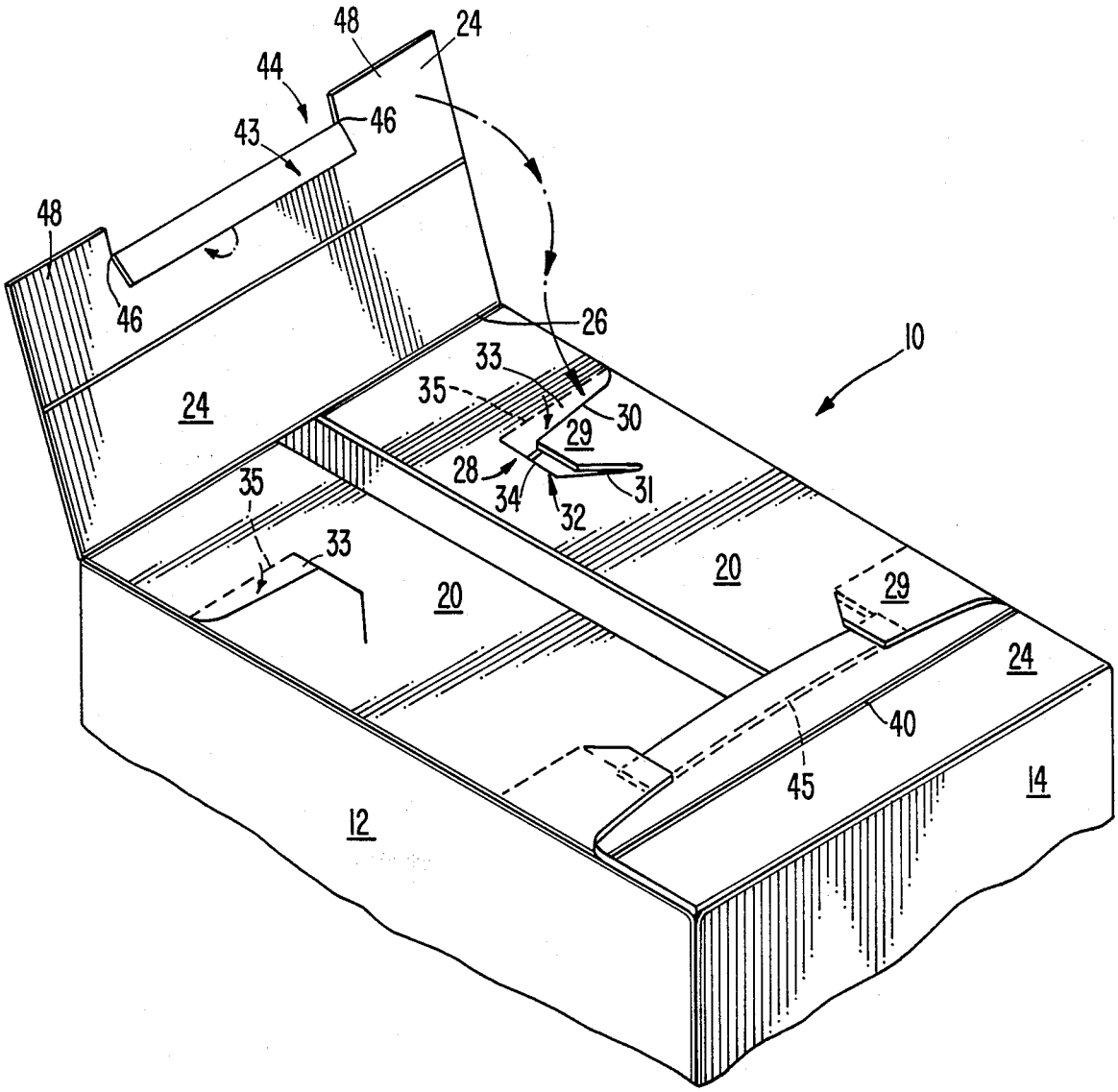
FIG. 1 is a perspective view of the partially assembled carton bottom closure of this invention, one of the minor flaps being shown interlocked with the pair of the major flaps.
Figure 2:
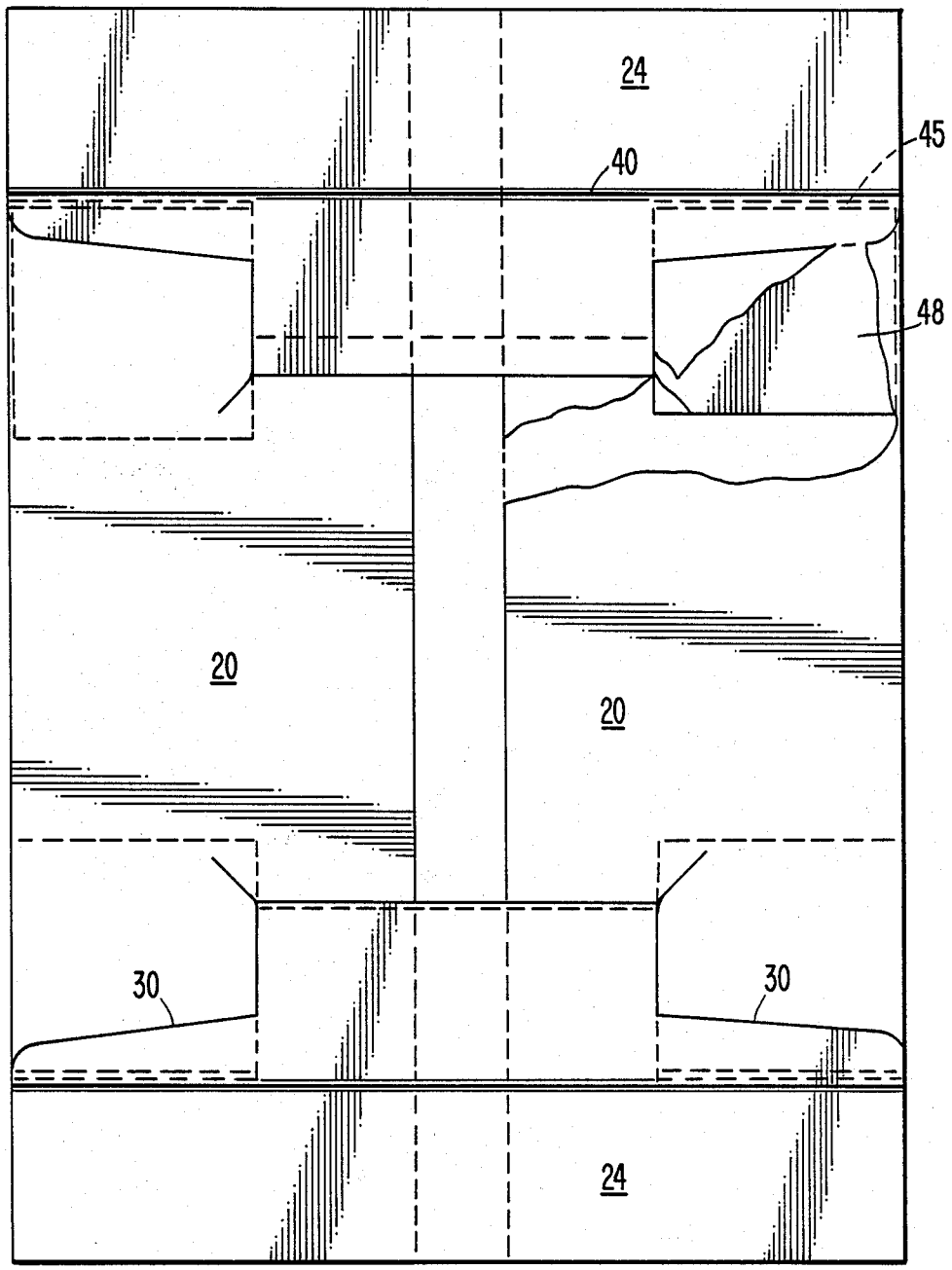
FIG. 2 is a bottom plan view of the assembled carton of FIG. 1 with a portion of a minor flap broken away.
Figure 3:
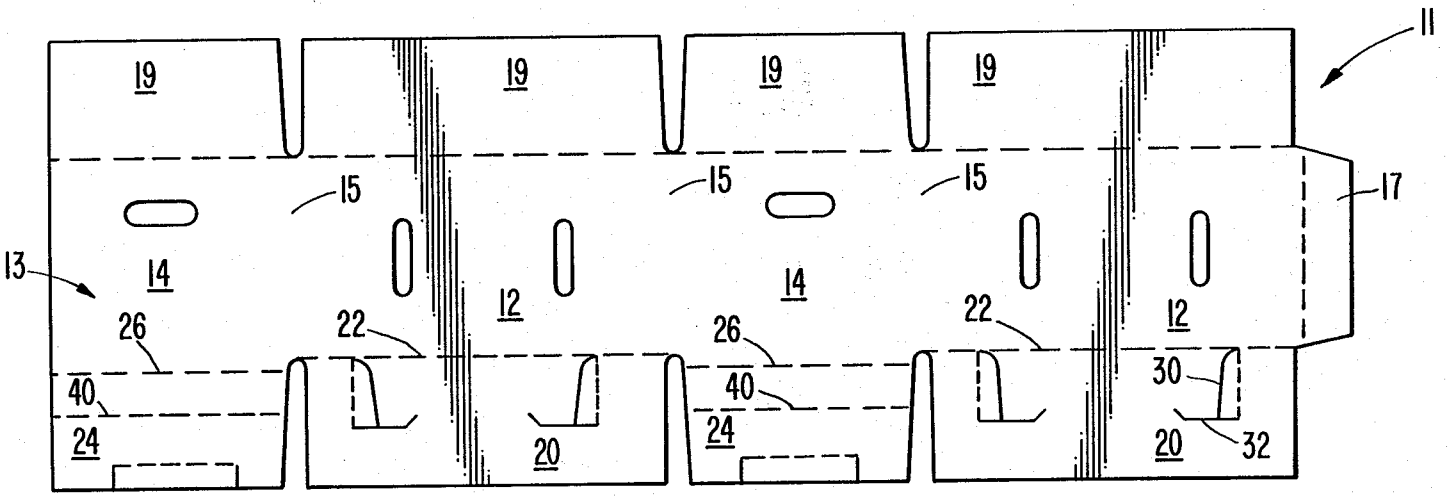
FIG. 3 is a plan view of a carton blank according to the present invention.

In the drawings the bottom closure of a carton 10 which is rectangular in shape is shown. Certainly it will be recognized that the relative dimensions of the pair of opposed sidewalls and pair of opposed end walls forming the carton are not important to the bottom closure which utilizes closure flaps that are hingedly connected along edges of the sidewalls and end walls.

Figure 5:
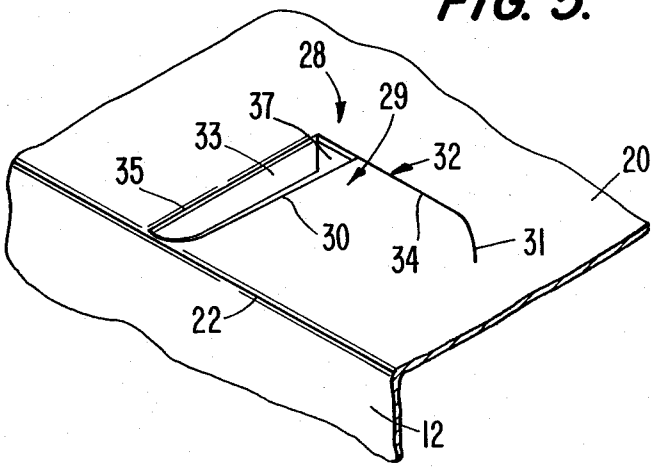
FIG. 5 is a partially cutaway perspective view of a major flap of the present invention.
Figure 4:
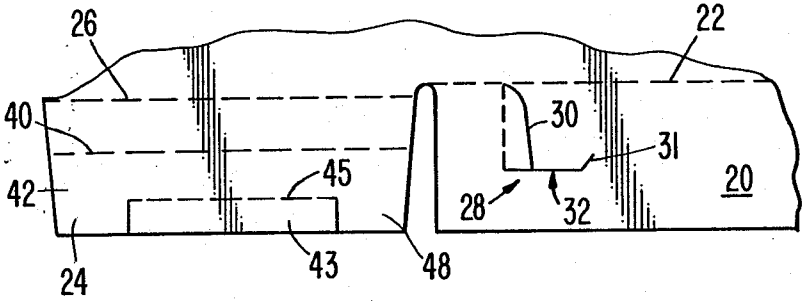
FIG. 4 is an enlarged, partially cutaway plan view of a major flap and a minor flap of the present invention.

It will also be recognized that the rectangular carton 10 such as shown on the drawings is to be formed from a single, generally rectangular unitary panel blank 11, as shown in FIG. 5. This blank is suitably cut, scored, perforated, etc. to be folded into the completed carton 10.

As may be best understood from FIG. 1, carton 10 has a generally tubular carton body providing a pair of opposed sidewalls 12 and a pair of opposed end walls 14, only one of each of the side and end walls 12 and 14 being visible in the perspective view of FIG. 1. As well-known in the manufacture of paperboard cartons, this tubular carton body is formed from a series of wall panels 13 which provide a pair of sidewalls and a pair of end walls. The panels are hingedly coupled together in series along parallel fold lines 15. The carton includes top flaps 19 and bottom flaps, as described in detail below. A fastening flap 17 at the end of the series of panels serves to connect the panels into the tubular carton body. The fastening flap is suitably glued, stapled or otherwise secured to form this series of panels into the tubular carton body, as is known and convention in the prior art.

in the formation of the carton blank which is folded into carton 10, each of the wall panels forming a sidewall 12 has a bottom major closure flap 20 hingedly connected along an edge thereof at hinge line 22. Likewise, each of the wall panels forming an end wall 14 has a bottom minor closure flap 24 hingedly connected along an edge thereof at hinge line 26. Collectively, when the two major flaps 20 and two minor flaps 24 are folded to lie perpendicular to the side and end walls 12 and 14 of the carton 10, these flaps form the bottom closure for carton 10.

A flap locking slit 28 is formed adjacent each end of each of the major flaps 20. Slit 28 has a first portion 30 and a second portion 32. First portion 30 extends across major flap 20 and terminates adjacent hinge line 22 which connects major flap 20 to sidewall 12 of the carton body. Preferably, first portion 30 of flap locking slit 28 is angularly disposed with respect to hinge line 22. The second portion 32 of flap locking slit 28 extends longitudinally of the major flap 20 and provides a locking edge 34 extending generally parallel to hinge line 22. The intersection of first portion 30 and second portion 32 of slit 28 defines a flap retaining segment 29 for retaining minor closure flaps 24 in their assembled position when inserted in flap locking slit 28, as further described below.

Second portion 32 of flap locking slits 28 is preferably formed transverse to the direction of corrugation of the paperboard and terminates in an angular slit 31 angularly disposed with respect to second portion 32 and angularly disposed to the direction of corrugation. Angular slit 31 extends from second portion 32 of flap locking slit 28 angularly towards hinge line 22 and terminates spaced from hinge line 22, as shown.

An assembly flap 33 is formed in major flap 20 adjacent first portion 30 of flap locking slit 28. Assembly flap 33 is hingedly connected to major flap 20 along an assembly flap hinge line 35. Assembly flap 33 may be folded inwardly along hinge line 35 thereby transforming second portion 32 of slit 28 into an assembly slot 37, as shown in FIG. 5. Assembly slot 37 facilitates inserting minor flaps 24 through major flaps 20, as further described below.

Assembly flap hinge line 35 is substantially perpendicular to hinge line 22. In this configuration, when assembly flap 33 is folded inwardly to thereby create assembly slot 37, assembly slot 37 will increase in width towards the outer end portion of major flap 20 to facilitate assembly of the carton. This increasing width is a result of the angularly disposed edge of first portion 30 of flap locking slit 28 and hinge line 35.

Each of the minor flaps 24 is scored to form a fold line 40 extending the full length of the minor flap. Fold line 40 segregates outer end portion 42 of minor flap 24 from an inner portion. Providing fold lines 40 enables minor flaps 24 to be readily and accurately folded to facilitate assembly of the carton in the manner as will be explained hereinafter.

End portion 42 of each minor flap 24 includes a generally rectangular flap locking segment 43 formed centrally along outer end portion 42 of minor flaps 24. Flap locking segment 43 is hingedly connected to minor flaps 24 along a hinge line 45. Flap locking segment 43 may thus be folded inwardly thereby defining a generally rectangular opening 44. The opposite ends of opening 44 define spaced locking edges 46. With the centrally formed opening 44 in the end portion 42 of minor flap 24 there are created a pair of projection tabs 48 on minor flap 24, these tabs being disposed laterally of the ends of opening 44 where the locking edges 46 are provided.

Having described the structure of the components making up the carton 10, the following will describe the manner in which the components are assembled in forming the rigid bottom closure for carton 10.

Initially, the two major flaps 20 are folded inwardly and essentially lie in a common plane. Flaps 20 may overlap for increased rigidity and strength or may not overlap, according to the particular application of the carton.

With the major flaps 20 positioned as described above, the two minor flaps 24 are folded inwardly over major flaps 20.

Flap locking segment 43 is folded inwardly along hinge line 45 to thereby define opening 44. Assembly flap 33 is folded inwardly along hinge line 35 to thereby define assembly slot 37. To facilitate introducing the tabs 48 into assembly slot 37 and slit 30 in major flaps 20, the end portion 42 of each minor flap 24 is folded along the scored fold line 40. In this partially folded condition the tabs 48 may be easily introduced into assembly slot 37, with locking edges 46 engaging locking edges 34. Then the partially folded end portion 42 of each flap 24 can be easily pressed down with locking edges 46 sliding along locking edges 34 until the minor flaps 24 assume a flat condition lying along the bottom of carton 10 leaving the major flaps 20 exposed on the interior of carton 10. With minor flap 24 thus inserted, flap retaining segment 29 prevents flap 24 from being dislodged from its assembled configuration. Angular slit 31 provides flexibility to flap retaining segment 29 to facilitate assembly.

With locking edges 46 engaged with the locking edge 34, the span of corrugated paperboard defined by the length of the edge of opening 44 provides a rigidifying effect to essentially prevent the major flaps 20 and the walls 12 to which they are hingedly connected from spreading apart. It should be noted that in studying the action of a carton which is being filled with heavy produce, characteristically the downward force applied by the produce being loaded tends to push out the bottom of the carton. Overlapped bottom major flaps in a carton automatically causes the flaps to push apart. The locking action of the bottom closure acts to stop this outward pushing action.

Carton 10, as thus constructed, provides a carton having a self-locking closure bottom with all the advantages of the carton previously disclosed in U.S. Pat. No. 4,650,112. Additionally, the carton of the present invention may be manufactured without generating any cutout segments or waste material. The flap locking segment 43 and assembly flap 33 remain affixed to the carton blank and do not become waste material which must be collected, packaged and disposed of during the manufacturing process. Moreover, the carton of the present invention does not generate any cutout segments which can jam the manufacturing machinery or otherwise interfere with the efficient stripping of the carton blank from the machinery.

It will be appreciated from the above disclosure of the invention, including illustration and description of a preferred embodiment of such invention, that the carton 10 may be easily folded from a single, generally rectangular blank into a strong carton having a rigid self-locking bottom closure. While the carton 10 might find particular applicability in being loaded, stored and transporting produce, it will be recognized that the carton is subject to utilization in a multitude of environments other than with produce.

Also, it is to be understood that the embodiment of the invention herein shown and described must be taken as a preferred representation of the invention. Thus, it will be obvious to one of ordinary skill in the art that numerous modifications and changes may be made without departing from the true spirit and scope of the invention which is to be limited only by the appended claims.

I claim:

1. A carton with a self-locking bottom closure comprising:

a pair of opposed sidewalls;

a pair of opposed end walls, said end walls being generally normal to said sidewalls;

a major closure flap hingedly connected to each of said sidewalls;

a hinge line at the connection of each of said sidewalls and said major closure flaps thereby hingedly connecting said sidewalls to said major closure flaps;

a minor closure flap hingedly connected to each of said end walls, said minor closure flaps having an outer end portion and an inner end portion, said inner end portion of said minor closure flaps serving to hingedly connected said minor closure flaps to said end walls;

a flap locking segment formed centrally along the outer end portion of each of said minor flaps, said flap locking segments hingedly connected to said minor flaps so that said flap locking segments may be folded inwardly thereby defining openings having spaced locking edges at opposite ends of said openings and projecting tabs on end portions of said minor flaps, said projecting tabs, disposed laterally of said ends of said openings;

a flap locking slit formed in each of said major flaps, each of said flap locking slits having a first portion extending partially across said major flaps and terminating adjacent said hinge line connecting the major flaps to the sidewalls of said carton body;

each of said flap locking slits having a second portion, said second portions providing locking edges extending generally parallel to said hinge lines connecting the major flaps to the sidewalls of said carton body;

a flap retaining segment formed in each of said major closure flaps by the intersection of said first portion and said second portion of each of said flap locking slits for retaining said minor closure flaps in their assembled position when inserted into said flap locking slits;

said second portions of said flap locking slits having flexibility means for providing flexibility to said flap retaining segments, said flexibility means comprising an angular slit angularly disposed with respect to said second portion of said flap locking slits;

a single transverse fold line extending the full length of each of said minor flaps to divide each of said minor flaps into outer and inner sections with each inner section being hingedly connected to one of said end walls and said tabs carried by said outer section;

said major and minor closure flaps being folded generally perpendicular to said side and end walls of said carton body, respectively, to form a carton bottom closure with said minor flaps each being folded along said fold line to have said tabs on said outer section inserted through said slits of said major flaps so that said locking edges of said opening in said minor flaps are lockingly engaged with said locking edges of said flap locking slits in said major flaps.

2. A carton as recited in claim 1 wherein said carton body is comprised of corrugated paperboard and said angular slit is angularly disposed to the direction of corrugation.

3. A carton as recited in claim 2 wherein said angular slit extends from said second portion of said flap locking slit angularly toward said hinge line between said sidewall and said major closure flap and terminates spaced from said hinge line.

4. A carton as recited in claim 1 wherein said first portion of said flap locking slit is angularly disposed with respect to said hinge line.

5. A carton as recited in claim 1 further comprising an assembly flap formed in said major flap adjacent said first portion of said flap locking slit, said assembly flap hingedly connected to said major flap along an assembly flap hinge line so that said assembly flap may be folded inwardly thereby creating an assembly slot to facilitate inserting said minor flaps through said major flaps.

6. A carton as recited in claim 5 wherein said first portion of said flap locking slits is angularly disposed with respect to said hinge line between said sidewall and major closure flap and wherein said assembly flap hinge line is substantially perpendicular to said hinge line between said sidewall and said major closure flap so that said assembly slot increases in width towards the outer end portion of said major flaps.

7. A paperboard blank for forming a carton, the blank comprising:

panels for forming a tubular carton body providing a pair of opposed sidewalls and a pair of opposed end walls, said pairs of walls being generally normal to each other;

each of said sidewalls having a major closure flap hingedly connected thereto, a hinge line forming a hinged connection between said sidewalls and said major closure flaps;

each of said end walls having a minor closure flap hingedly connected thereto, said minor closure flaps having an outer end portion opposite and spaced from the connection between said minor closure flaps and said end walls;

a flap locking segment formed centrally along the outer end portion of each of said minor flaps, said flap locking segments hingedly connected to said minor flaps so that said flap locking segments may be folded inwardly thereby defining openings having spaced locking edges at opposite ends of said openings and further defining projecting tabs on the outer end portion of the minor flaps, said tabs being disposed laterally of said opposite ends of said openings;

a flap locking slit formed in each of said major flaps, each of said flap locking slits having a first portion extending partially across said major flaps and terminating adjacent said hinge lines connecting the major flaps to the sidewalls of said carton body;

each of said flap locking slits having a second portion, said second portion providing a locking edge extending generally parallel to said hinge lines connecting the major flaps to the sidewalls of said carton body, said second portions intersecting said first portions;

the intersection of said first portions and said second portions defining flap retaining segments for retaining said minor closure flaps in their assembled position when inserted into said flap locking slits;

said second portions of said flap locking slits having an angular slit angularly disposed with respect to said second portion of said flap locking slits for providing flexibility to said flap retaining segments; and a single transverse fold line extending the full length of each of said minor flaps to divide each of said minor flaps into outer and inner sections with each inner section being hingedly connected to one of said end walls and said tabs carried by said outer section.

8. A paperboard blank as recited in claim 7 wherein said blank is comprised of corrugated paperboard and said angular slit is angularly disposed to the direction of corrugation.

9. A paperboard blank as recited in claim 8 wherein said angular slit extends from said second portion of said flap locking slit angularly toward said hinge line between said sidewall and said major closure flap and terminates spaced from said hinge line.

10. A paperboard blank as recited in claim 7 wherein said first portion of said flap locking slit is angularly disposed with respect to said hinge line.

11. A paperboard blank as recited in claim 7 further comprising as assembly flap formed in said major flap adjacent said first portion of said flap locking slit, said assembly flap hingedly connected to said major flap along an assembly flap hinge line so that said assembly flap may be folded inwardly thereby creating an assembly slot to facilitate inserting said minor flaps through said major flaps.

12. A paperboard blank as recited in claim 11 wherein said first portion of said flap locking slit is angularly disposed with respect to said hinge line between said sidewall and major closure flap and wherein said assembly flap hinge line is substantially perpendicular to said hinge line between said sidewalls and said major closure flap so that said assembly slot increases in width towards the outer end portion of said major flaps.

* * * * *